US007143552B2

(12) United States Patent
Vander Park

(10) Patent No.: US 7,143,552 B2
(45) Date of Patent: Dec. 5, 2006

(54) SUPPORTING SPINE STRUCTURE FOR MODULAR OFFICE FURNITURE

(75) Inventor: Antonius A. Vander Park, Caledon (CA)

(73) Assignee: Nova-Link Limited, Ontario (CA)

( * ) Notice: Subject to any disclaimer, the term of this patent is extended or adjusted under 35 U.S.C. 154(b) by 413 days.

(21) Appl. No.: 10/228,225

(22) Filed: Aug. 26, 2002

(65) Prior Publication Data

US 2004/0035067 A1 Feb. 26, 2004

(51) Int. Cl.
*E04C 2/52* (2006.01)

(52) U.S. Cl. ..... 52/220.7; 52/238.1; 52/220.1; 52/481.2

(58) Field of Classification Search ..... 52/220.7, 52/239, 36.1, 36.6, 238.1, 36.4, 481.2, 241, 52/242, 220.1; 108/50.02, 50.01, 23; 312/223.3, 312/196, 140.1
See application file for complete search history.

(56) References Cited

U.S. PATENT DOCUMENTS 4,224,769 A * 9/1980 Ball et al. ..... 52/36.1
4,838,177 A * 6/1989 Vander Park ..... 108/155
5,058,331 A 10/1991 Epps
5,065,556 A * 11/1991 DeLong et al. ..... 52/220.7
5,081,808 A 1/1992 Bastian et al.
5,362,923 A * 11/1994 Newhouse et al. ..... 174/48
5,606,919 A * 3/1997 Fox et al. ..... 108/50.02
5,899,025 A * 5/1999 Casey et al. ..... 52/36.1
6,076,903 A * 6/2000 Vander Park ..... 312/196
6,152,048 A * 11/2000 Vander Park ..... 108/50.02
6,158,179 A * 12/2000 Ackerly et al. ..... 52/220.7
6,283,043 B1 * 9/2001 Stern et al. ..... 108/50.02
6,339,907 B1 * 1/2002 Dame et al. ..... 52/239
6,481,168 B1 * 11/2002 Hodges et al. ..... 52/220.7
6,546,684 B1 * 4/2003 Waalkes et al. ..... 52/239
6,557,310 B1 * 5/2003 Marshall et al. ..... 52/220.1
6,658,805 B1 * 12/2003 Yu et al. ..... 52/239

FOREIGN PATENT DOCUMENTS

DE 1437931 2/1969
DE 2207344 12/1998

(Continued)

OTHER PUBLICATIONS

NL Nova Link, "Serious Furniture Solutions for Technology Intensive Work Environments," Series 4.0, Jun. 2000.

(Continued)

*Primary Examiner*—Basil Katcheves
(74) *Attorney, Agent, or Firm*—Gifford, Krass, Groh, Sprinkle, Anderson & Citkowski, P.C.

(57) ABSTRACT

A support beam and a support frame for an office furniture system which can be used to mount and support a variety of furniture system components and electrical and communication equipment. The support beam has an elongate, hollow lower beam section with a top panel and vertical side panels. An elongate upper beam rail having a top extends parallel to and spaced-apart from the lower beam section. This rail has a plurality of post-receiving holes formed in its top for mounting other components such as a support wall. Spaced apart posts rigidly connect the beam rail to the lower beam section. Rail connecting devices are provided at opposite ends of the beam rail for rigidly connecting it to an adjacent end of another beam rail or to the support frame. The support frame has a horizontal metal beam and two elongate, hollow end frame sections extending downwardly from opposite ends of the beam. A raceway is rigidly mounted on a lower portion of this beam and extends downwardly therefrom.

34 Claims, 7 Drawing Sheets

FOREIGN PATENT DOCUMENTS

| | | |
|---|---|---|
| EP | 0 006 707 | 9/1980 |
| EP | 0 145 410 | 6/1985 |
| GB | 2345845 A | 7/2000 |

OTHER PUBLICATIONS

NL Nova Link, "One Product/One Process", Series 4.25, Jul. 2001.
NL Nova Link, "Serious Furniture Solutions for Technology Intensive Work Environments," Series 4.0, Jun. 2000.
NL Nova Link, "One Product/One Process", Series 4.25, Jul. 2001.
NLnovalink, "One Product/One Process-Trading Desks", Series 4.25, Oct. 2001.
Nova-Link Brochure entitled "Spine Frame Trading Desks", Series 4.25 (undated).
Nova-Link Brochure entitled One Product/One Process, Series 4.5 (undated).
Nova-Link Catalogue Brochure, Series III, vol. 2/96, Flexibility and Simplicity, the quaterly global review.

* cited by examiner

SUPPORTING SPINE STRUCTURE FOR MODULAR OFFICE FURNITURE

BACKGROUND OF THE INVENTION

This invention relates to support beams or support spines for an office furniture system, particularly a system of the modular type, which can be used to support not only work surfaces but also office equipment such as computers and telephone systems.

A variety of modular office furniture systems have been developed by various companies. These systems can be used to construct office desks and workstations having a variety of configurations and layouts. Modular furniture systems can also be made from a variety of materials, including metal, wood and suitable plastics. Each system is generally provided with a number of standard, basic components such as supporting frames, supporting beams, and work surfaces and these components make it possible to provide a furniture arrangement that is particularly suited for an individual customer's needs.

In recent years, with the development of the electronic office and the more extensive and wide spread use of computers, particularly personal computers, modular office furniture systems that take into account the need to support and hold electronic and computer equipment have been developed. In fact, in many modern offices, there is a need for a substantial amount of electrical and electronic equipment to be accommodated together with communication equipment in a relatively small space and the necessary wiring and cables for this equipment must be routed to the equipment in a manner which not only does not detract from the appearance of the office but also enables relative easy installation of the equipment and the subsequent servicing thereof.

The use of support beams as a basic component of a modular office furniture system is well known in the art. These support beams can be supported above the floor by means of suitable support legs or posts and wiring and cable can be routed through the interior of the beam. The use of a support beam of this type is described and illustrated in U.S. Pat. No. 4,838,177 issued Jun. 13, 1989 to Nova-Link Limited, which is also the assignee of the present application. The disclosure and drawings of this United States patent are incorporated herein by reference. The beam in this patent has a rectangular transverse cross-section that includes a top panel or plate and two vertical side plates connected together by the top plate. The beam also has a bottom plate and all sides of the beam, including the top and bottom, are formed with access openings through which wiring can be run, for example.

In more recent U.S. Pat. No. 6,076,903 issued Jun. 20, 2000 to Nova-Link Limited, there is disclosed a modular workstation system which incorporates a support beam of the aforementioned type. In this system, a support wall is mounted on top of the beam by means of upright posts and connecting slats extend horizontally along this wall. This workstation system also teaches the use of an open mesh raceway that can be mounted on the support posts for the wall and is located a short distance above the beam. Suitable holes formed in the top of the beam are capable of receiving the wall posts. The disclosure and drawings of this U.S. patent are also incorporated herein by reference. It will be noted that in both of U.S. Pat. Nos. 4,838,177 and 6,076,903, the support beam, although mounted in an elevated position above the floor by means of supporting legs, is still located a substantial distance below the top of the work surface which can be mounted on one or both sides of the beam by means of support brackets.

Another workstation system for an office is disclosed in U.S. Pat. No. 4,224,769 which issued Sep. 30, 1980. The beam assembly in this U.S. patent has a height which extends from approximately knee height to work surface height. The beam assembly includes a centrally disposed I-beam having upper and lower closed box sections that are interconnected by an unbroken vertical, central web. This I-beam is reinforced by an upper channel member which has up turned flanges affixed to the top of the upper box section. An additional channel member can be affixed to the bottom of the lower box section to increase rigidly. The space between the upper and lower box sections defines horizontal raceways (made of bent sheet metal) for laying the electrical and communication wiring. Cover panels are also provided for the top and sides of this beam assembly. Difficulties with this known beam assembly include the fact that there are no openings through the interconnecting web section of the beam to allow wiring and cables to pass through this section of the beam in the transverse direction and the beam is not designed for use with other types of central frame supports which may be desirable for certain types of office equipment or for certain modular office furniture requirements.

It is an object of the present invention to provide an improved support beam for an office furniture system that can be made at a reasonable cost while at the same time being quite strong and capable of being used in a variety of ways.

It is a further object of the present invention to provide an improved support frame for an office furniture system which includes an elongate beam capable of carrying electrical and communication wires, elongate end frame sections extending downwardly from opposite ends of the beam, and an open mesh raceway mounted on a lower portion of the beam and extending downwardly from this lower portion.

According to a further object of the present invention, there is provided an improved support frame which includes an elongate beam constructed with at least one central cavity extending downwardly from holes in the top of the beam and which has fastener holes in walls forming this cavity for securing posts that can be mounted in the top of the beam.

SUMMARY OF THE INVENTION

According to one aspect of the invention, a support apparatus for an office furniture system includes an elongate, hollow lower beam section having top and bottom panels and vertically extending side panels extending between and rigidly connecting the top and bottom panels. At least some of these panels have access openings formed therein. An elongate, upper beam rail having a top forming a horizontally extending top surface extends parallel to and is spaced-apart from the lower beam section. This beam rail has a plurality of spaced-apart post-receiving holes formed in the top surface and extending through its top for mounting other components of the office furniture system on the upper beam rail. The height of this beam rail is less than the height of the beam section. Vertically extending, spaced-apart, elongate posts rigidly connect the upper beam rail to the lower beam section. In addition, the beam rail includes at least one rail connecting device provided and located at at least one end of the beam rail for rigidly connecting the at least one end of the beam rail to an adjacent end of another beam rail or to other compatible support structure.

In the preferred embodiment, there is an open meshed raceway mounted on at least one side of the elongate posts and extending the length of the support beam.

According to another aspect of the invention, a support frame for an office furniture system includes an elongate, horizontal beam adapted for carrying electrical and communication wires and cables and having a too forming a horizontally extending top surface, this beam having a plurality of spaced-apart, post-receiving holes formed in the top surface end extending through its top for mounting other components of the office furniture system on the horizontal beam. Two elongate end frame sections extend downwardly from opposite ends of the beam and are rigidly connected thereto. An open meshed raceway is rigidly mounted on a lower portion of the horizontal beam and extends along the length thereof. This raceway extends from the lower portion of the beam and has a horizontal raceway section located directly under at least an upper portion of the beam.

In a preferred embodiment, the raceway includes an elongate connecting strip that extends along the top of the raceway and is detachably connected to the lower portion of the beam by fasteners.

According to a further aspect of the invention, a support frame assembly for an office furniture system includes an elongate, horizontal metal beam adapted for carrying electrical and communication wires and cables and having a top forming a horizontally extending top surface, this beam having a plurality of spaced-apart holes formed in the top surface and extending through the top for mounting posts for one or more components of the office furniture system on the metal beam. The beam is constructed with at least one central cavity extending downwardly from the holes in its top and defined by opposite vertical walls of the beam. Fastener holes for securing the posts are provided in the vertical walls with one or more of these fastener holes being aligned in the transverse direction of the beam with each of the holes in the top of the beam. There are also two end frame sections extending downwardly from opposite ends of the beam and rigidly connected thereto. These end frame sections each have a bottom end adapted for mounting on a floor.

Preferably the metal beam of the support frame is a welded frame assembly that includes two spaced-apart, substantially channel shaped frame member, each of which has a connecting central section forming one of the aforementioned vertical walls and outwardly extending top and bottom leg sections respectively connected to a top and a bottom of the central section. The central cavity is formed between the two central sections.

According to a still further aspect of the invention, a supporting frame assembly for an office furniture system includes an elongate, hollow lower beam section having a top panel and vertically extending side panels rigidly connected to the top panel. At least some of the panels have access openings formed therein. An elongate upper beam rail having a top extends parallel to and is spaced apart from the lower beam section. This beam rail has a length substantially equal to the length of the lower beam section and has rail connecting end flanges at opposite ends of the beam rail. The end flanges have fastener holes formed therein. Vertically extending, spaced-apart frame members rigidly connect the upper beam rail to the lower beam section. A support leg arrangement is provided to mount the lower beam section and its connected beam rail in a horizontal position above the floor. The frame assembly further includes an elongate, horizontal metal beam member having a top and adapted for carrying electrical and communication wires and cables. Also, two elongate, end frame sections extend downwardly from opposite ends of the metal beam member to floor level. These frame sections are rigidly connected to the metal beam member with one of the end frame sections being rigidly connected to an end of the lower beam section and to one end of the beam rail by means of one of the end flanges. The top of the metal beam member is at substantially the same height as the top of the upper beam rail during use of the frame assembly. Both the upper beam rail and the metal beam member have a plurality of spaced-apart, post-receiving holes formed in their respective tops for mounting other components of the office furniture system.

In a preferred embodiment of the frame assembly, open-meshed horizontal raceways are mounted on both the spaced-apart frame members and the metal beam member and each raceway is at substantially the same height as the other raceway.

Further features and advantages will be come apparent from the following detailed description taken in conjunction with the accompanying drawings.

DETAILED DESCRIPTION OF PREFERRED EMBODIMENTS

Figure 1:
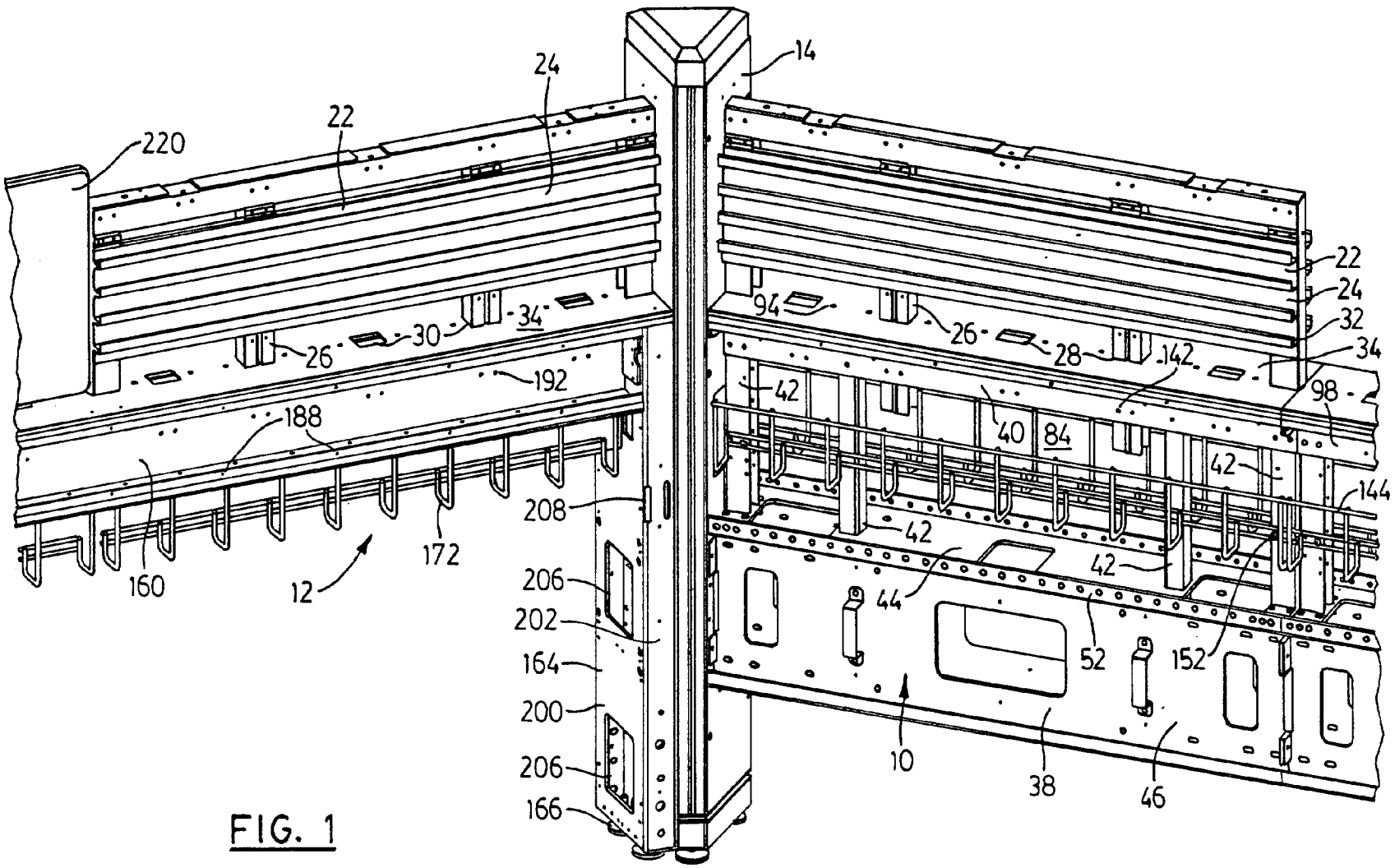
FIG. 1 is a perspective view taken from above and from the front and showing a support beam on the right and a portion of a support frame on the left, both constructed in accordance with the invention, and both connected to a support post.
Figure 2:
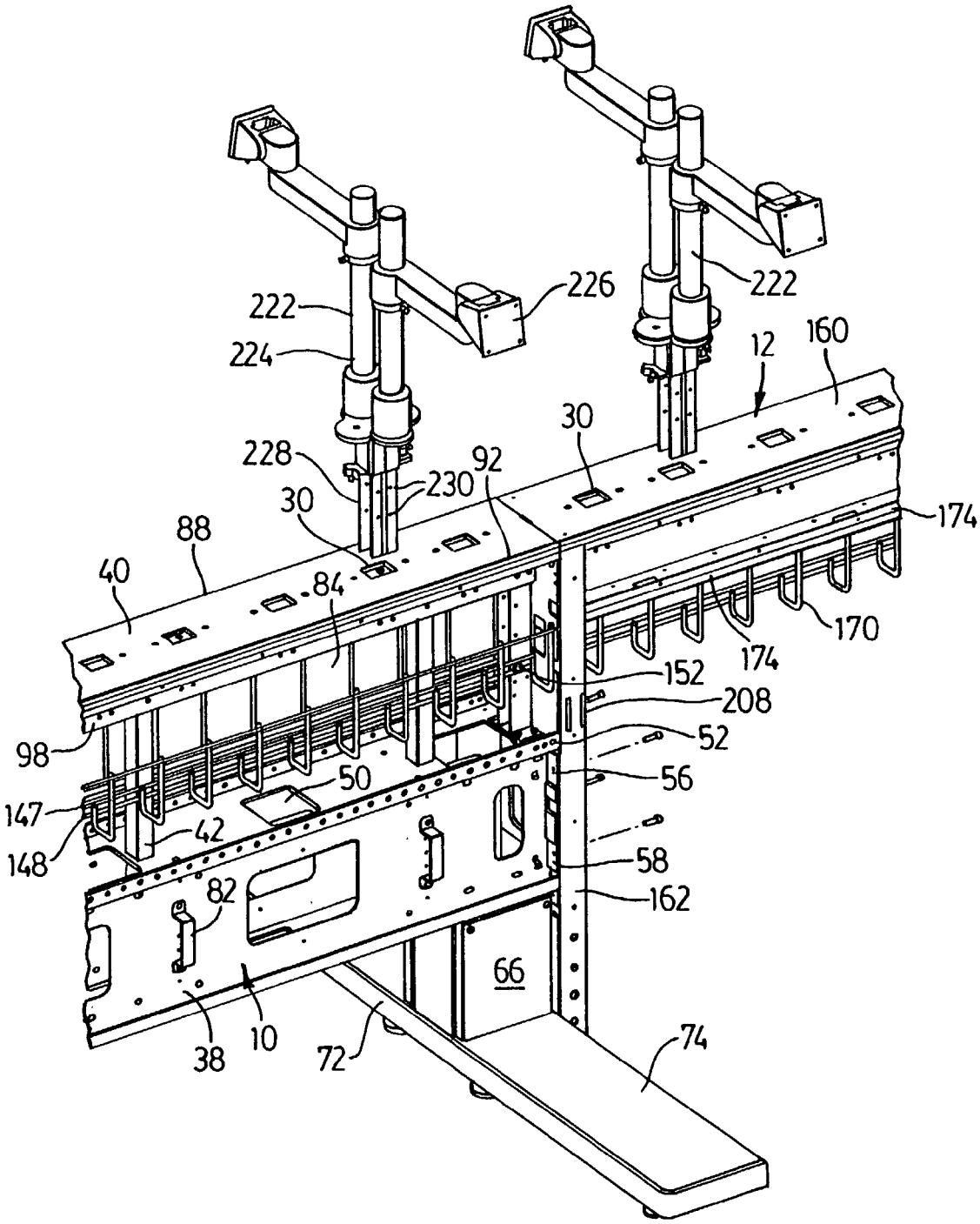
FIG. 2 is another perspective view taken from one side and from above and illustrating a portion of a support frame on the right side and a portion of a support beam on the left side, one end of the beam being supported by a standard support leg.
Figure 3:
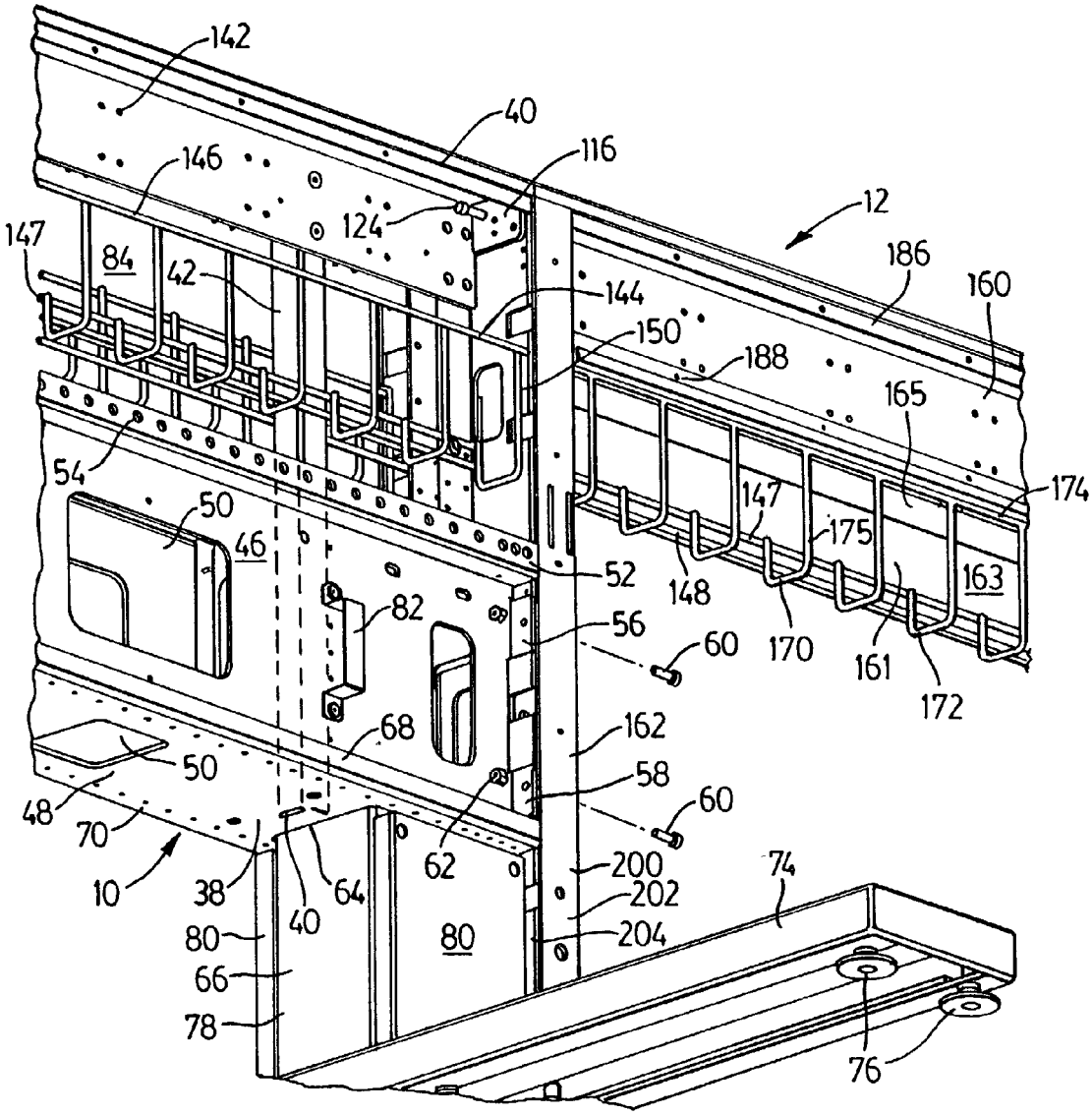
FIG. 3 is another perspective view showing a portion of a support frame on the right and a portion of a support beam on the left, this view being taken from below and from one side of the beam and the frame.

In FIGS. 1 to 3, there are shown both a novel support beam or spine beam 10 for a modular office furniture system and a support frame or spine frame 12 for such a system which can be used in combination with this support beam. Various configurations are possible for the support beam 10 and the support frame 12, including configurations that include a direct connection between the support beam and the support frame as shown in FIGS. 2 and 3 and an indirect connection by means of a vertical support or junction post 14, shown in FIG. 1. The junction post 14 can, for example, permit the support beam 10 to extend at an obtuse angle relative to the support frame 12 as shown.

It will be understood that the support beam 10 and the support frame 12 of the invention can be used to construct and assemble both single sided and double sided workstations suitable for offices and the like. These workstations are particularly suited for mounting computer or television monitors, display equipment, communication equipment, and keypad touch equipment and also for providing a work surface in front of or above this equipment. Horizontal work surfaces of known construction are shown at 16 in FIGS. 6, 8 and 9. The work surface can be mounted on known types of support brackets such as the brackets 18 to 20 shown respectively in FIGS. 6, 8 and 9. The construction of the support bracket 20, for example, is illustrated and described in applicant's earlier U.S. Pat. No. 6,076,903, the disclosure and drawings of which are incorporated herein by reference. The support brackets 19, 20 are detachably connected to one side of the support beam 10 as shown and it will be appreciated that they can also be attached to both sides of the beam if a double sided workstation is desired. With the use of the preferred embodiments of the support beam 10 and the support frame 12, the attached work surfaces 16 can be arranged to interface (ie. align) with one another in an identical manner whether they are mounted to support beams 10 by a cantilevered connection (see FIGS. 8 and 9) or they are mounted to support frames 12.

Also shown in FIG. 1 is the use of a known form of support wall 22. Support wall sections are shown mounted on both the support beam 10 and the support frame 12. The use of a support wall of this type is illustrated and described in the aforementioned U.S. Pat. No. 6,076,903. The illustrated support wall includes a panel covered section that has front and back metal panel members 24. Each section of the support wall is rigidly connected to the beam 10 or the support frame 12 by means of vertical support columns or posts 26 which extend through holes 28 formed in the top of the beam and holes 30 formed in the top of the support frame. Due to the rigidity of the posts 26 and the metal panels attached to these posts and the secure manner in which these posts are mounted in both the support beam 10 and the support frame (as further explained hereinafter), the installed support wall 22 is quite strong and rigid and can support shelving and other items of considerable weight connected thereto. By preferably making the holes 28 and the holes 30 of the same size and by spacing them apart the same distance, the support beam 10 and the support frame 12 are receptive to the same form and size of riser panels, that is, the support wall sections 22. This helps to reduce manufacturing costs and inventory costs. Preferably each of the metal panels of the wall is provided with several horizontal connecting rails 32 integrally formed thereon. Each rail is preferably L-shaped in cross-section with an upwardly extending leg spaced from the outer or front surface of the panel member. It will be also noted that the bottom edges of the panel members are preferably spaced some distance above the top of both the support beam and the support frame as illustrated. Thus, there is an open space 34 between the top of the beam and the panel member and between the top of the support frame 12 and the panel member for the passage of wires and cables.

Turning now to the construction of the support beam 10 of the invention, this beam comprises several major components including an elongate, hollow lower beam section 38, an elongate, upper beam rail 40 and vertically extending, spaced-apart elongate posts 42. The lower beam section which has a metal top 44 is similar in its construction to the support beam described and illustrated in the earlier U.S. Pat. Nos. 4,838,177 and 6,076,903 referred to above. Thus, this beam section has a generally rectangular transverse cross-section with its long side 46 extending vertically. These long sides consist of metal side panels that extend between and rigidly connect top panel 44 to a bottom panel 48 (see FIG. 3). As illustrated, all of these panels preferably have access openings 50 provided therein, the illustrated openings being rectangular with rounded corners.

Each of the side panels 46 is bent twice at the top to form a L-shaped connecting flange 52. The upright leg of this flange has a series of bolt holes 54 formed therein, which holes can be used for the attachment of the aforementioned support brackets 19 and 20. If desired, the flanges 52 can be reinforced by an adjacent flange formed on opposite side edges of the top panel 44. The top and bottom panels and the metal side panels of the lower beam section are rigidly secured together by welding. Because of its rigid construction, the beam 10 can be used to cantilever and support lower zone equipment, such as a CPU support ray, off the face of the beam.

Preferably, each of the side panels 46 is formed with at least one connecting end flange which can be secured to the outside surface of the support frame 12, for example. As illustrated, each side panel 46 has two end flanges 56, 58, each formed with at least one hole to receive a connecting bolt 60 which is secured in place by a nut 62. It is, of course, also possible to connect the support beam 10 directly to the end of another similar support beam and the end flanges 56, 58 of each support beam can be used for this purpose as well. The beams can be manufactured so as to have a relatively short standard length, ie. four feet. If a longer beam is required, the short beams can be connected to form a long beam.

With specific reference to FIG. 3 which shows the bottom of the support beam, each end of the lower beam section can be formed with a rectangular opening 64 for insertion of the top end portion of a support leg 66 which per se is of known construction. The opening is preferably not enclosed at the adjacent beam end. The bottom panel 48 has up turned edge flanges 68. A series of bolt holes can be formed adjacent the side edges of the bottom plate along its entire length, if desired.

Figure 8:
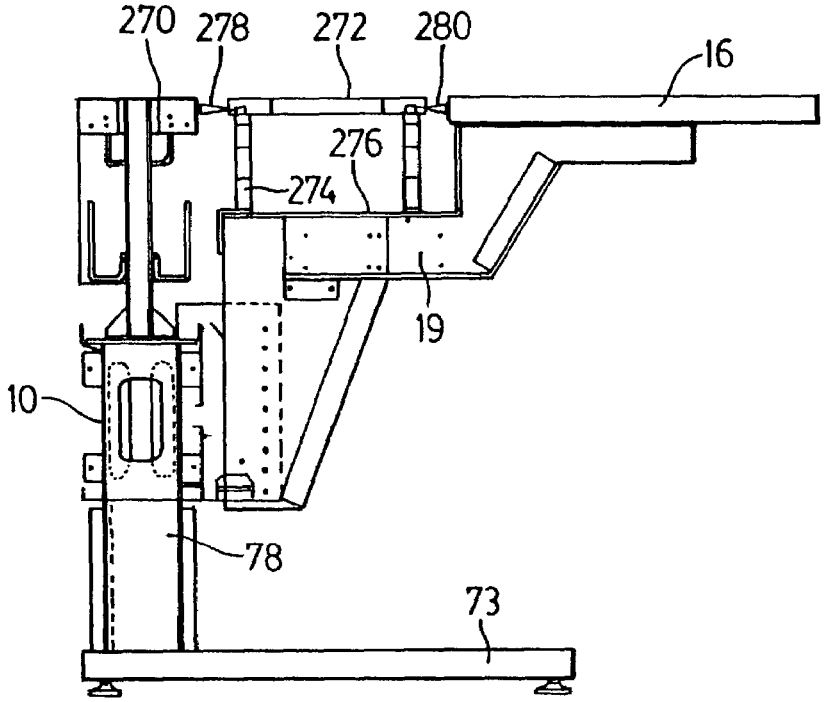
FIG. 8 is an end view of the support beam on which has been mounted an outwardly extending support bracket and a work surface.
Figure 9:
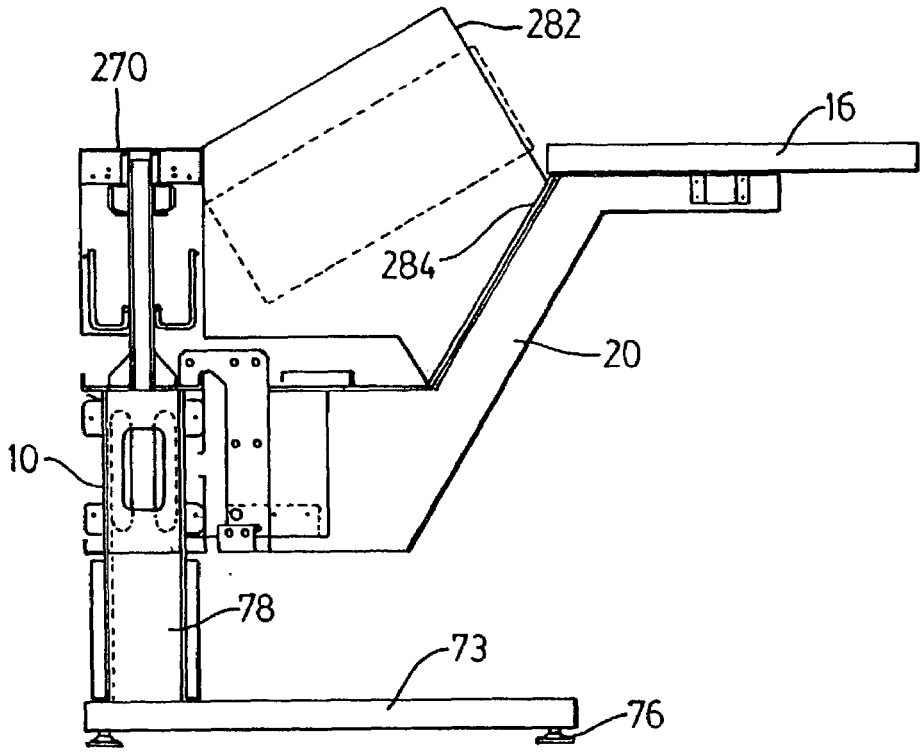
FIG. 9 is an end view of the support beam similar to FIG. 8 but showing an alternate form of support bracket connected to a side of the beam and illustrating how a computer monitor can be mounted on the beam and the bracket.

The illustrated support legs 66 can have two feet 72, 74 as shown in FIG. 2, these feet extending horizontally. However, it is also possible to have a support leg with a single foot 73 as illustrated in FIGS. 8 and 9. All of these feet are preferably provided with adjustable levelers 76 which can be of well known construction. The upright portion 78 of each leg preferably has a rectangular horizontal cross-section, the horizontal dimensions of which correspond closely to the dimensions of the opening 64 in the bottom of the beam. Preferably both the top and bottom ends of the portions 78 are open to permit cables and wires to be run up through this portion of the leg and into the beam. In a known manner, the upright portion can itself be formed with access openings (not shown) in its sides and these openings can be covered with removable cover plates or panels 80.

An additional preferred feature of the lower beam section is the attachment of a plurality of exterior brackets 82 that can be attached by screws by each of the side panels. These brackets can be used to run electrical cable (armored) along the outside of the lower beam section.

Turning now to the construction of the new upper beam rail 40, this beam rail extends parallel to and is spaced-apart from the lower beam section 38. Thus, there are substantial open spaces 84 formed between the lower beam section and the beam rail and these open spaces permit wires and cables to be run transversely through the central portion of the support beam 10, if required.

Figure 4:
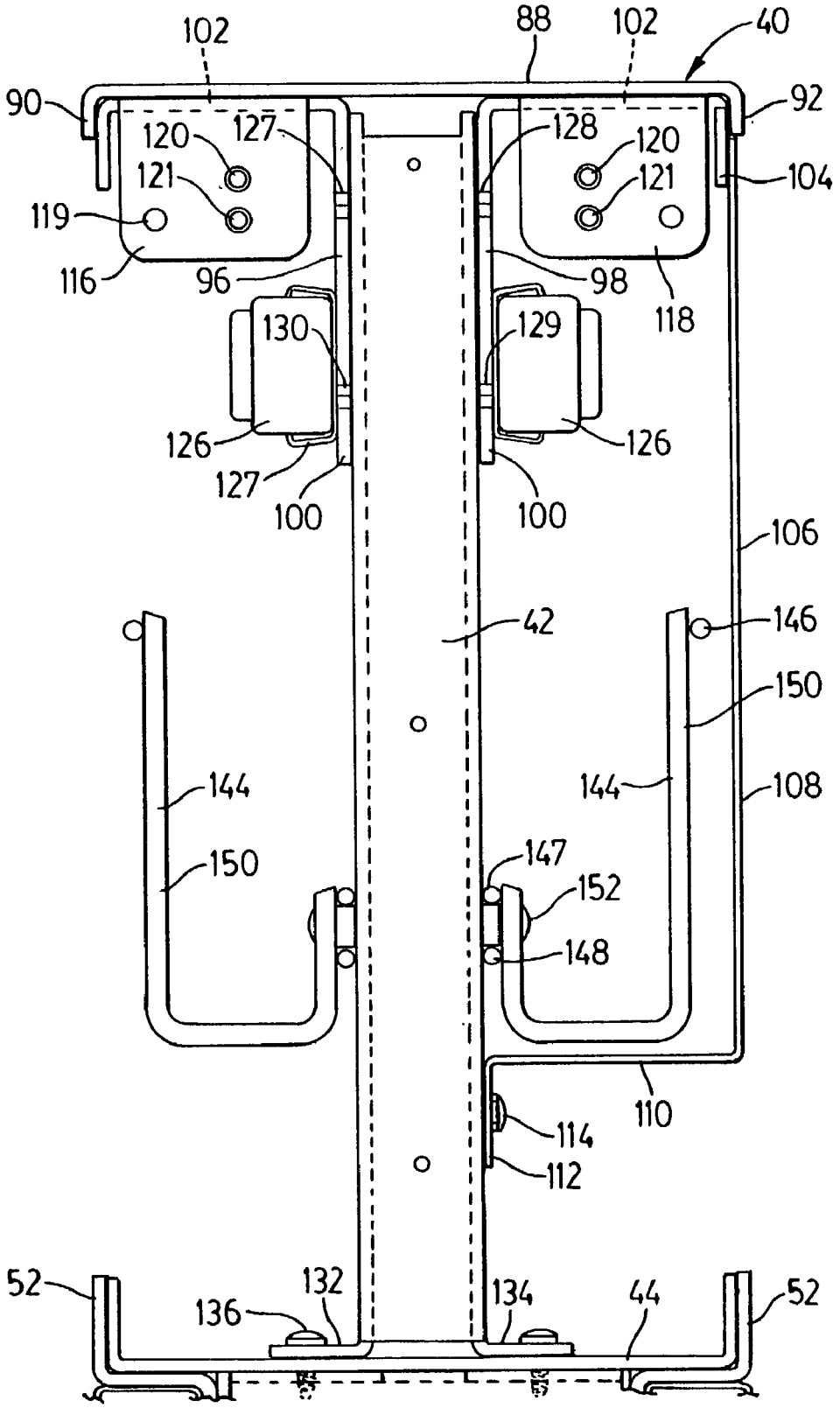
FIG. 4 is a detail elevational end view of the upper section of a support beam constructed in accordance with the invention.

The construction of the upper beam rail can be seen clearly from an examination of FIG. 4 which shows an end view of this rail as well as one of the upright posts 42 attached thereto. In particular, the beam rail includes an elongate top plate or channel member 88 that extends the entire length of the beam rail and that preferably has two downwardly extending edge flanges 90 and 92 which can be quite short, as shown. The member 88 forms a top of the beam rail and defines a horizontally extending top surface. The aforementioned spaced-apart holes 28 are distributed evenly along the length of this channel member. The holes 28 are formed in the top surface of the beam rail and extend through the top of the beam rail. Screw or bolt holes 94 can be provided adjacent to each of the holes 28. These can be used to attach other modular furniture components, electrical equipment or posts to the top of the support beam 10, when required. The beam rail further includes two elongate angle frame members 95, 98 each of which has a downwardly extending leg section 100 attached to the adjacent posts 42 and an outwardly extending leg section 102 that is attached to the aforementioned channel member 88. The angle frame members can be rigidly and permanently connected to the channel member 88 by welding and all of these members can be made from strong 11 gauge steel plate. Preferably, each angle frame member also has a downwardly extending outer flange 104. Optionally, there can be detachably connected to this outer flange a removable cover 106 which can be made of light gauge metal or a suitable plastic. The top of this cover is preferably bolted or attached by screws to the flange 104 arid the cover is connected also at the bottom to the adjacent post 42. The illustrated cover has a vertical cover section 108, a much narrower horizontal section 110 and a short, downwardly projecting connecting flange 112. Suitable holes are formed in the flange 112 for connecting bolts or screws 114 that attach the cover section to their respective posts.

Shown in FIGS. 3 and 4 are rail connecting devices 116, 118 that are provided and located on opposite ends of the beam rail for rigidly connecting the ends of the beam rail 40 to adjacent ends of other beam rails or to other compatible support structure, for example, the aforementioned support frame 12. The preferred rail connecting devices comprise two connecting flanges at each end of the beam rail, these flanges extending downwardly from the channel member 88 and being substantially rectangular. Each connecting flange has fastener holes formed therein with the illustrated flanges having three holes 119 to 121. The holes 120, 121 can be threaded as indicated in FIG. 4. One or more machine screws 124 (see FIG. 3) can be used to attach each of these flanges to the adjacent face of the support frame 12, for example. Also shown in FIG. 4 are two plug molds 126 which are attached by clips 127 to the angle frame members 96, 98. As these plug molds are of standard construction, a detailed description herein is deemed unnecessary. It is also possible to attach a power bar 99 (see FIG. 7) of standard construction, for example, one made by Wiremold, instead of the plug molds shown. It should be appreciated therefore that it is possible to mount electrical outlets on the outward faces of the beam 10 (that is, at the beam rail) and in a similar manner it is also possible to mount electrical outlets on the outward faces of the support frame 12 and these electrical outlets can be approximately at the same level below the top. Thus both the beam 10 and the frame 12 are similar in their function in this respect as well.

Turning now to the manner of attachment of the posts 42, these posts can be attached by four countersunk screws to the upper beam rail 40, the location of these screws being indicated at 127 to 130. The two posts 42 at the opposite ends of each support beam 10 are formed with outwardly extending connecting flanges 132, 134, each of which can be attached by two bolts 136 to the top panel 44 of the lower beam section. These end posts are connected in this manner so as not to interfere with the insertion of a leg 66 into the end section of the beam.

However, the internal posts 42 of which there are two in the illustrated embodiment are connected in a different manner than the end posts. In particular, each of these posts extends through a substantially rectangular opening formed in the top panel 44 and extends downwardly across the beam cavity to the top of the bottom panel 48. This is illustrated in dash lines in FIG. 3. The bottom of each of these posts is secured against movement relative to the bottom plate. In the illustrated and preferred embodiment, there is a small slot 140 formed in the bottom panel 48 for each of the inner posts 42. A tang is formed on one side of each of the inner posts 42 and this tang extends snugly into its respective slot 140 to hold the bottom of the post rigidly upright. In this way, each of the posts is able to provide strong, rigid support for the upper beam rail 40 attached thereto.

In addition to the screw holes provided to attach the frame members 96, 98 to their respective posts, there are also provided in the angle frame members a series of additional screw holes 142 which can be provided as shown in spaced-apart groups of four. These screw holes can be used to secure in place the aforementioned vertical posts 26 for the support wall 22. It will be noted that the posts 42 of the support beam are located so as to not to interfere with the insertion of the posts 26 into the holes in the top of the upper beam rail 40.

Another preferred feature of the support beam 10 is the provision of an open meshed raceway 144 mounted on at least one side of the elongate posts 42 and extending the length of the support beam 10. In the illustrated preferred embodiment, there are raceways mounted on both sides of the support posts. These raceways are formed from welded together wires including longitudinally extending straight wires 146, 147 and 148 and J-shaped wires 150. The preferred raceways are attached by a series of screws 152 to the posts 42. These screws can be trapped between the ends of the straight wires 147, 148 as illustrated in FIG. 4. It will be understood that wires and cables can be laid along these raceways as required. If desired, the raceways can be covered by the aforementioned removable covers 106.

In a preferred embodiment of the support beam 10, the width of the beam, including the width of the upper beam rail, is six inches. Preferably, the width of the upper beam rail is the same as the width of the lower beam section. The height of the lower beam section including the connecting flanges 52 is nine inches while the overall height of the support beam 10, including the posts 42 and the upper beam rail, is twenty inches. When this support beam 10 is mounted on standard support legs as shown, the top of the beam is approximately twenty-nine inches from floor level.

Figure 5:
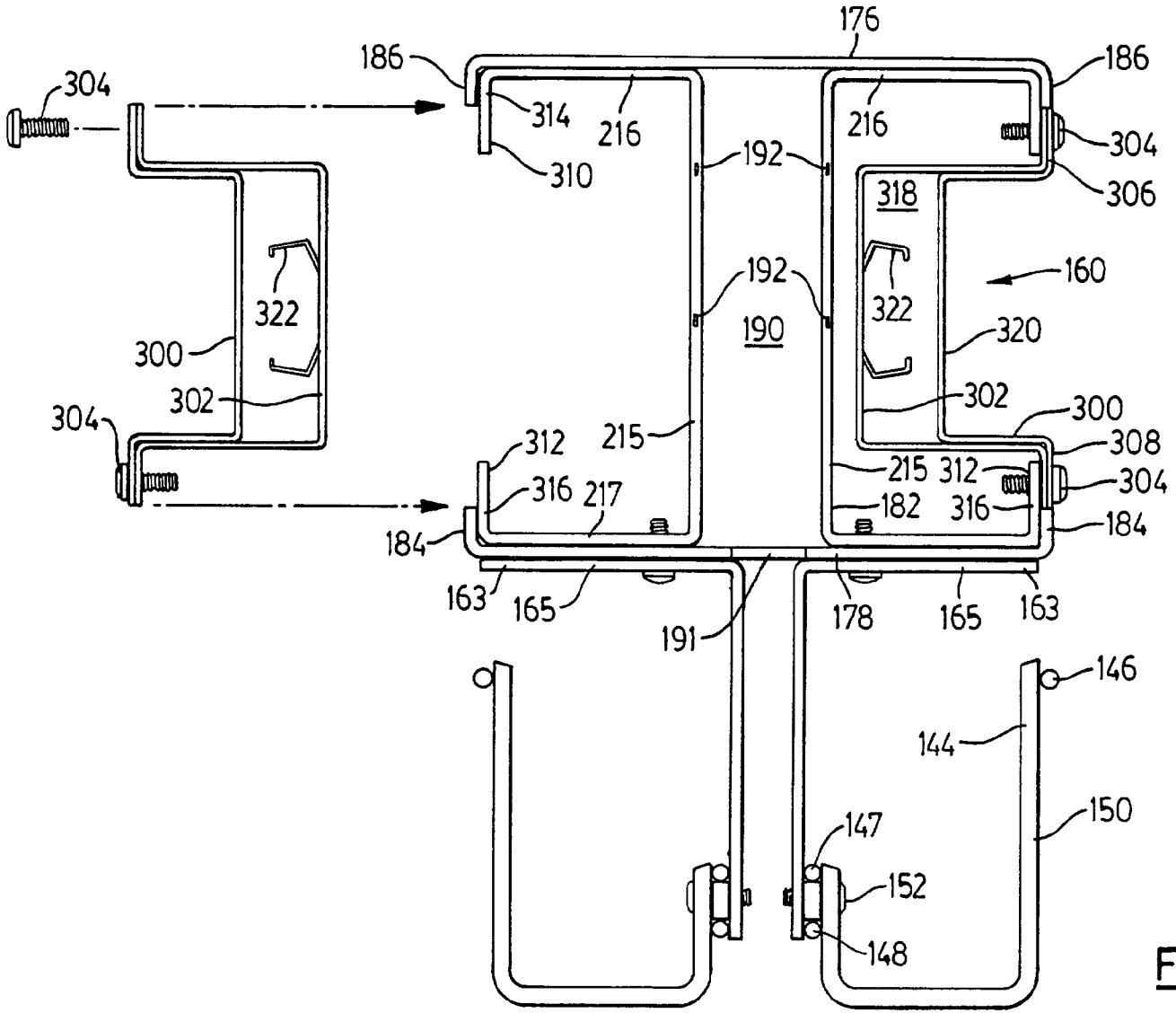
FIG. 5 is a detail end view showing the upper portion of the support frame of the invention, in particular, the horizontal metal beam.

Turning now to the construction of the aforementioned support frame 12 which can be used in combination with the aforementioned support beam, this support frame includes an elongate, horizontal metal beam 160 adapted for carrying electrical and communication wires and cables by means of passageways formed therein. In one preferred embodiment, the beam 160 has a height of five inches. It will be understood that both this metal beam and the aforementioned upper beam rail 40 are preferably constructed from eleven gauge sheet metal having sufficient strength for support purposes. The support frame further includes two elongate end frame sections 162 and 164 which can be of identical construction. These end frame sections extend downwardly from opposite ends of the beam 160 and they are rigidly connected thereto. As illustrated in FIGS. 1 and 2, these end frame sections are preferably of sufficient length that they extend down to floor level and thus they help support the metal beam 160 on a floor. Two adjustable levelers 166 can be mounted at the bottom end of each end frame section for engagement with the floor. The levelers are mounted in a bottom flange or bottom wall formed on the end frame section. Another feature of the support frame is the provision of an open meshed raceway 170 which can be similar in its construction to the aforementioned raceway 144, except for the differences noted hereinafter. The raceway 170 is rigidly mounted on a lower portion of the horizontal beam 160 and extends the length thereof. Elongate connecting wires 147, 148 on the inner side of the raceway are connected by screws or bolts to a vertically extending leg 161 of an angle frame member 163 that is attached by screws or bolts to the bottom of metal beam 160 (that is, to a frame member 178 shown in FIG. 5 and described below). There are two of the angle frame members 163, the top, horizontal legs 165 of which are shown in FIG. 5. The frame members 165 are spaced apart a short distance as shown. The raceway extends along the lower portion of the beam and it has a horizontal raceway section 172 located directly under the upper portion of the beam. In this way, the raceway does not add to the overall width of the support frame which, in the illustrated preferred embodiment is the same width as the support beam 10, for example, six inches. The position of the raceway also enables other components or equipment to be placed up against the side of the beam, for example, the side extension unit described hereinafter.

The illustrated preferred raceway includes an elongate, connecting wire 174 that extends along a top of the raceway and that is welded to a series of spaced-apart J-shaped wires 175.

The preferred construction of the metal beam 160 can be seen from the detail view provided by FIG. 5. The beam 160 includes upper and lower channel shaped frame members 176, 178 that are spaced apart and connected by interconnecting frame members 180, 182. These frame members can be rigidly and permanently connected by means of spot welding. The lower channel shaped frame member 178 has two upwardly extending edge flanges 184 on opposite longitudinal sides thereof. Similarly, the upper channel shaped frame member 176 preferably has two downwardly extending edge flanges 186. The frame member 176 preferably matches the top plate 88 of the beam rail and extends the full length of the support frame 12. The connecting frame members 180, 182 form a central post-receiving, longitudinally extending slot 190 between them as shown in FIG. 5. The aforementioned holes 30 are located along the top end of the slot 190 and it will be understood that the width of these holes in the transverse direction of the beam is about equal to the width of the slot 190. There is also a tang receiving slot 191 formed in the frame member 178 below each hole 30. A tang can be provided on the bottom of each post 26 and insertion of this tang in the slot 191 will secure the post bottom. Also, the frame member 178 prevents the bottom of the post from projecting below the bottom of the beam 160. Also, the interconnecting frame members 180, 182 have a series of fastener holes 192 distributed along their length for the purpose of securing the vertical post 26 or other items in or to the metal beam 160. As can be seen from FIG. 1, these holes 192 or a grouping thereof are in transverse alignment with the respective one of the holes 30 in the top of the beam 160. As illustrated in the preferred embodiment of FIG. 3, there are four fastener holes 192 in each group. Screws can be used to secure each post 26 in place.

As shown in FIG. 5, each vertical side of the beam 160 is covered by means of two channel-shaped trim covers 300, 302 that overlap and are attached by means of screws 304. Holes are formed in top and bottom edge flanges 306, 308 of both trim covers and the screws 304 extend through these holes. Holes 310, 312 are also formed in downwardly extending flanges 314 and in upwardly extending flanges 314 and in upwardly extending flanges 316 of the frame members 180, 182 and the screws 304 are mounted in these holes. The screws 304 at the lower portion of the beam can also be used to attach the raceway 170.

One purpose of the two trim covers 300, 302 is to form a longitudinal passageway 318 between the two covers for a continuous plug mold (not shown) of known construction per se. By having suitable outlet openings 320 formed in the outer trim cover 300, only the electrical outlet is visible to and exposed to the user of the support frame 12. Metal C-shaped clips 322 are mounted on the inner trim cover 302 to support the plug mold in a detachable manner.

The preferred construction of each end frame section 162, 164 will now be explained. In particular, each of these end frame sections can be constructed as a welded assembly made from two substantially channel-shaped frame members with their edge flanges directed towards one another. One of these channel-shaped members is indicated at 200 in FIG. 3 and it is this channel-shaped member which has its two edge flanges 202 on the outside of the edge flanges of the other channel-shaped member 204. The two channel-shaped members 200 and 204 extend substantially to the top of the support frame 12 but their top ends are covered by the upper channel-shaped member 176 of the beam to provide a smooth top for the support frame. From FIGS. 1 to 3 it will be seen that the support beam 10 and the support frame 12 are so constructed that the top of the beam rail 40 is aligned heightwise with the top of the metal beam 160 of the support frame creating a smooth and pleasing appearance and a spine system that is very adaptable to meet the particular requirements of an office workstation site. As already explained, one of the end frame sections 162, 164 can be firmly and detachably connected by fasteners to one end of an adjacent support beam 10 if this is required for the particular workstation configuration. Other features of each end frame include rectangular access opening 206 which can be formed on both sides of each end frame section. Also, various fastener holes can be provided on the sides of the end frame section for attachment purposes, for example, to attach a decorative cover (not shown) to a visible side of the end frame section. Also, an attachment slot 208 can be provided on both side edges of each end frame section for the purpose of attaching a standard support bracket to the end frame section.

Returning to the construction of the metal beam 160 as illustrated in FIG. 5, the two channel-shaped frame members 180, 182 can be considered as having a connecting central section 215 that forms one of the vertical walls of the beam that define the central cavity 190. Also, each frame member 180, 182 has outwardly extending top and bottom leg sections 216, 217, respectively connected to a top and a bottom of the central section. In the illustrated preferred embodiment, these leg sections are L-shaped in cross-section but it is also possible to construct the beam with flat leg sections, if desired. It will thus be appreciated that the central cavity 190 is formed between the two central sections 215 of the frame members.

As indicated, it is possible to attach a variety of modular office furniture components to either the support beam 10 or the support frame 12. In the left side of FIG. 1, there is illustrated the possibility of mounting a so-called riser 220 or partition on the support frame and for this purpose the holes 30 in the frame can also be used. The riser can be covered with fabric to form a smooth, decorative surface or it can be made with glass or plexiglass so that it will be transparent or translucent. A riser can also be made from perforated metal in a manner known per se.

FIG. 2 illustrates the possibility of mounting a piece of equipment other than a wall or riser on either the support frame or the support beam. In particular, there is shown mounted on each of the support beam 10 and the support frame 12 a LCD monitor post 222, the upper portions of which indicated at 224 are standard, off the shelf, monitor support posts which adjustably support a mounting plate 226. The standard monitor post is attached to a specially made bottom post section 228 that is sized and adapted to fit into one of the holes 30. The post section 228 can be made, for example, using two back-to-back channel members having suitable fastener holes 230 formed therein. It will be understood that these holes 230 are aligned with the fastener holes 142 in the support beam in order to secure the monitor support posts in position.

Figure 6:
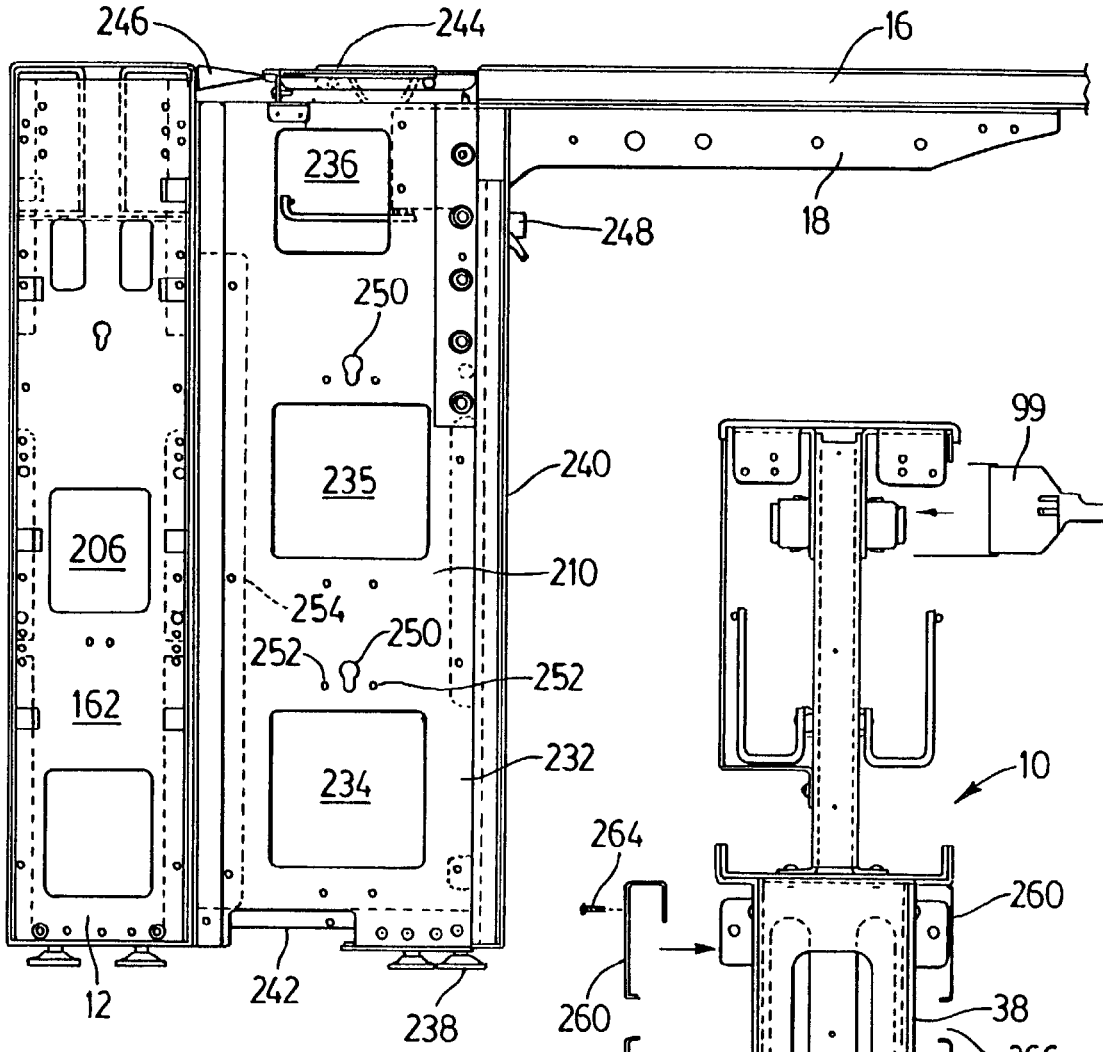
FIG. 6 is an end view of a support frame constructed in accordance with the invention, attached to a frame extension to which is connected a horizontal work surface.

FIG. 6 in addition to illustrating one end of the support frame 12, also illustrates a side extension unit 210 or frame extension to which is bolted the brackets 18 that project horizontally and outwardly. This frame extension can be of standard construction per se and accordingly a detailed description herein is deemed unnecessary for purposes of the present invention. The extension can include two metal, vertical end panels 232 in which can be formed several access openings 234 to 236. Floor levelers 238 can be provided at the bottom end of each end panel on a suitable support flange. On the outwardly facing surface of the extension unit there can be mounted one or two hinged doors 240. A latch 248 which can have a locking feature is provided to open and close the doors 240. If the doors are hinged, the hinges can extend vertically and be located along the outer edge surfaces of the end panels. It is instead possible to provide sliding doors, if desired. Of course, by opening these doors, full access can be gained not only to the interior of the extension unit 210 but also to the space surrounded by the support frame 12.

Also shown in FIG. 6 is a cut-out 242 which is provided at the bottom of each end-panel of the extension unit. This cut-out is provided so that cables can traverse along the floor below the extension unit. At the top of the extension unit there is shown a removable access panel 244 and again the construction of this panel is known per se. A brush type divider or joint cover is provided at 246 to close the horizontal gap between the panel 244 and the top of the support frame. In order to improve the external appearance of the extension unit, it is possible to mount a wooden or fabric panel to the outside of each end panel, for example, by using key hole mounts 250. If required, there can be mounted in the illustrated access openings one or more electrical junction boxes of standard construction and fastener holes 252 can be provided for this purpose. It should also be noted that although only one standard size of extension unit 210 is illustrated, these extension units can be provided in a variety of widths ranging from ten inches to twenty-four inches. The inner side edge of each end panel of the extension unit can be connected to the support frame 12 by a connecting frame 254 that can be detachably connected to both the unit 210 and the support frame by suitable screws or bolts.

Figure 7:
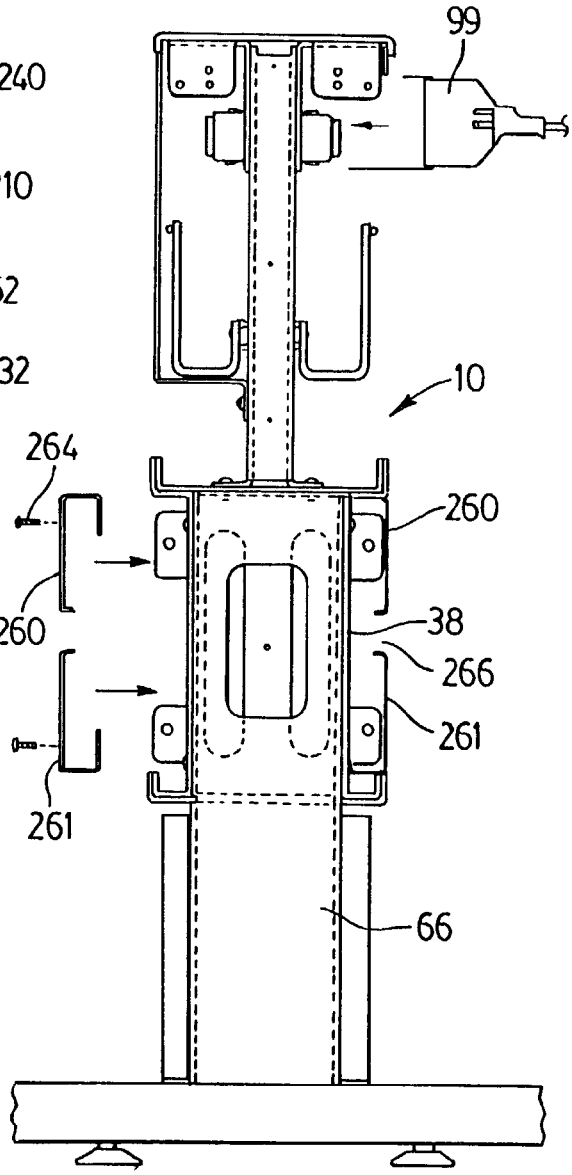
FIG. 7 is an end view of a support beam constructed in accordance with the invention, this beam being mounted on a support leg.

FIG. 7 illustrates a support beam 10 constructed in accordance with the invention mounted on a leg 66. This figure illustrates how the longitudinal, vertical sides of the lower beam section 38 can optionally be covered on each side using two separate beam covers 260, 261. The left side shows these beam covers as separate components ready to be attached while the right side of the figure shows two of these beam covers attached to the lower beam-section. These covers are attached by means of screws 264. After these covers are attached, there is a central, longitudinal slot 266 formed and it will be appreciated that wiring and cables can be fed out of the beam through this slot from the internal cable routes in the beam. It will be understood that the covers preferably extend the entire length of the lower beam section and can be made of either a suitable plastic or metal. The cables that come through the slot can be connected to service a standard universal service module (USM—not shown) mounted on the side of the beam.

Turning to FIG. 8 of the drawings, this view illustrates how the support beam 10 of the invention can be used in an efficient manner with a work surface 16 arranged at a normal desk top height, for example, about twenty-nine inches. It will be seen that the top of the beam at 270 is at the same level as the top of the work surface 16. Using a support bracket 19 of the type illustrated in FIG. 8, the gap between the top of the beam and the work surface can be readily filled in by a removable access panel 272 which can be supported by vertical legs 274. The legs 274 can in turn rest on either two or more of the support brackets 19 or a horizontal support surface extending between the brackets at the intermediate level 276. If desired, brush type joint covers 278, 280 can be mounted on opposite side edges of the panel 272. It will be understood that wiring for communication or computer equipment can be run up from the raceway of the beam through the joint covers to the equipment which may be arranged either on the panel 272 or on the work surface 16.

FIG. 9 illustrates another possible use for the new support beam 10. In this variation, a computer monitor or television screen is schematically illustrated at 282. The rear end of the monitor can be firmly and rigidly supported by the top of the beam by a suitable mounting bracket or strap (not shown). The front of the monitor can be supported at 284 by either the support bracket 20 or by a sloping support panel extending between two or more of the brackets 20. Because a large portion of the monitor is arranged below the work surface 16, it is still possible for the user to see over the monitor, if desired, and additional equipment can be mounted above the monitor, for example, on a support wall (not shown).

From the above description and the accompanying drawings it will be seen that the new support beam 10 and the support frame 12 described herein provide a number of advantages to users of modular office furniture systems. For example, the preferred forms of the support beam 10 and the support frame 12 can be made interchangeable for many applications because of common features incorporated therein including the fact that they can be made the same height. The preferred support beam 10 and support frame 12 can be constructed to accept identical mounting hardware.

Also, there can be continuous cable management between the support beam and the preferred support frame, for example, because the raceways can be mounted at the same height and in an end to end manner. It will also be seen that the running of cables between the cable bus of the beam 10 and the bus, ie. the slot 190 of the frame 12, is relatively continuous making the buses easier to use. Also, the same types of riser modules or supporting walls can be mounted on the preferred forms of the beam and the frame and thus the support beam and the support frame can support cantilevered console modules, for example, by means of the illustrated support brackets. Both the support beam and the support frame can be used as core components for more elaborate modular office furniture constructions. For example, in addition to supporting a single level of slat wall as illustrated in FIG. 1, it is also possible for the support beam and the support frame to support multiple levels of the slat wall sections. The aforementioned U.S. Pat. No. 6,076,903 explains in detail how these slat wall sections can be constructed in order that the slat wall sections can be mounted one on top of the other, if desired. As illustrated in FIG. 1, it is possible for the preferred support beam and the preferred support frame to be attached to one or more configurations of a junction post (rather than to one another) and this permits, for example, a support beam to be run at an angle to an adjacent support frame or to another support beam. It is also possible to construct the support beam and the support frame so that they support the same trim parts, thereby reducing manufacturing and supplying costs.

It should be noted that for some modular furniture applications, for example, certain types of console structures, the use of a support beam 10 is required while for certain other applications such as back side accessible rack mount attachments, the use of the support frame 12 is required. For example, the support beam 10 can be used to support CPU equipment in a cantilevered mode off the sideface of the beam. On the other hand, the support frame 12 is able to hold CPU equipment within its internal space below the horizontal beam (ie. at floor level). Therefore, because of the innerchangeability of the present support beam and the support frame, various required combinations of both can be assembled to meet a wide variety of applications and requirements. It will be appreciated that the support frame 12 as illustrated allows for back access to equipment mounted therein or on the frame and other equipment such as upright computers and computer servers can be located directly under the frame. One important advantage that can be achieved with the preferred version of the support beam and the support frame 12 is that they can be finished by means of similar or identical trim panels (including end trim panels) to have a similar and coordinated appearance. This is desirable in an office environment where the pleasing appearance of the completed furniture system is a feature sought after by the end users. The similar appearance is achieved in part by the same heights of their top surfaces and the same depths. In the case of the side trim panels used on the support beam 10 and on the support frame, although they can have a similar appearance, they are supported at different locations (on the beam as compared to the support frame) because of the differences in construction between the support beam and the support frame.

It will be appreciated by those skilled in the art that various modifications and changes can be made to the described support beam and support frame without departing from the spirit and scope of this invention. Accordingly, all such modifications and changes as fall within the scope of the appended claims are intended to be part of this invention.

I claim:

1. A support apparatus for an office furniture system, comprising:

an elongate, hollow lower beam section having top and bottom panels and vertically extending, side panels extending between and rigidly connecting said top and bottom panels, at least some of said panels having access openings formed therein, an elongate, upper beam rail having a top forming a horizontally extending top surface and extending parallel to and spaced-apart from said lower beam section, said beam rail having a plurality of spaced-apart post-receiving holes formed in said top surface and extending through said top of the beam rail for mounting other components of said office furniture system on said upper beam rail, the height of said beam rail being less than the height of said beam section, said beam rail including an elongate channel member having two downwardly and vertically extending edge flanges and forming said top of the upper beam rail, said post-receiving holes being distributed evenly along the length of said channel member, said beam rail further including two elongate, angle frame members each having a downwardly extending leg section and an outwardly extending leg section which is attached to said channel member; and vertically extending, spaced-apart elongate posts rigidly connecting said upper beam rail to said lower beam section, said downwardly extending leg section of each angle frame member being attached to said elongate posts, wherein said beam rail includes at least one rail connecting device provided and located at at least one end of said beam rail for rigidly connecting said at least one end of said beam rail to an adjacent end of another beam rail or to other compatible support structure.

2. A support apparatus according to claim 1 wherein an open-meshed raceway is mounted on at least one side of said elongate posts and extends the length of said support beam.

3. A support apparatus according to claim 2 including a removable cover panel attachable to said beam rail and extending over said open-meshed raceway during use thereof.

4. A support apparatus according to claim 1 wherein at least some of said elongate posts extend into said lower beam section and have bottom ends mounted in and secured by said bottom panel.

5. A support apparatus according to claim 4 wherein said lower beam section has upwardly extending connecting flanges extending along opposite longitudinal sides of said top panel, said connecting flanges being adapted for connection of support brackets usable for supporting a work surface or console on said support beam.

6. A support apparatus according to claim 4 wherein said posts include two end posts located at opposite ends of the lower beam section and the upper beam rail, bottom ends of said two end posts are secured by fasteners to said top panel, and said lower beam section has a bottom opening at each end thereof adapted for receiving a vertical support leg used to support said beam above a floor.

7. A support apparatus according to claim 4 wherein said access openings include access openings formed in said top panel and located between said elongate posts.

8. A support apparatus according to claim 1 including two removable elongate cover panels attachable to one side of said lower beam section so as to leave an elongate slot between said cover panels, said cover panels in use covering most of the adjacent side panel of the lower beam section and said slot in use permitting wiring and cables to be fed out of said lower beam section from an interior region thereof.

9. A support frame for an office furniture system comprising:

an elongate, horizontal beam adapted for carrying electrical and communication wires and cables and having a top forming a horizontally extending top surface, said beam having a plurality of spaced-apart, post-receiving holes formed in said top surface and extending through said top for mounting other components of said office furniture system on said horizontal beam, said beam including separate upper and lower channel-shaped frame members that are spaced apart by and connected by interconnecting frame members, said lower channel-shaped frame member having two upwardly and vertically extending edge flanges on opposite longitudinal sides thereof, said interconnecting frame members including two, spaced-apart connecting frame members welded to both of said upper and lower channel-shaped frame members and forming a central post-receiving, longitudinally extending slot between them, said post-receiving holes being located along a top end of said slot;

two elongate end frame sections extending downwardly from opposite ends of said beam and rigidly connected thereto; and an open-meshed raceway rigidly mounted on a lower portion of said horizontal beam and extending along the length thereof, said raceway extending from said lower portion of said beam and having a horizontal raceway section located directly under at least an upper portion of said beam, said raceway including elongate connecting wires that extend along an inner side of said raceway and being detachably connected to said lower portion of the beam by means of said wires and fasteners.

10. A support frame according to claim 9 wherein said interconnecting frame members have a series of fastener holes formed therein and distributed along their respective lengths, each of said fastener holes or a group thereof being in transverse alignment with a respective one of said post-receiving holes in the top of the beam.

11. A support frame according to claim 9 in combination with and rigidly connected to a support apparatus comprising:

an elongate, hollow lower beam section having top and bottom panels and vertically extending, side panels extending between and rigidly connecting said top and bottom panels, at least some of said panels having access openings formed therein, an elongate, upper beam rail having a top forming a horizontally extending top surface and extending parallel to and spaced-apart from said lower beam section, said beam rail having a plurality of spaced-apart post-receiving holes formed in said top surface and extending through said top of the beam rail for mounting other components of said office furniture system on said upper beam rail, the height of said beam rail being less than the height of said beam section; and vertically extending, spaced-apart elongate posts rigidly connecting said upper beam rail to said lower beam section, wherein said beam rail includes at least one rail connecting device provided and located at at least one end of said beam rail for rigidly connecting said at least one end of said beam rail to an adjacent end of another beam rail or to other compatible support structure, said top of said beam rail is aligned heightwise with said top of said beam of said support frame, and an adjacent one of said end frame sections is detachably connected by fasteners to one end of said support apparatus.

12. A supporting frame assembly for an office furniture system comprising:

an elongate, hollow lower beam section having a top panel and vertically extending side panels rigidly connected to said top panel, at least some of said panels having access openings formed therein, an elongate upper beam rail having a top and extending parallel to and spaced-apart from said lower beam section, said beam rail having a length substantially equal to the length of said lower beam section and having rail connecting end flanges provided at opposite ends of the beam rail, said end flanges having fastener holes formed therein;

vertically extending, spaced-apart frame members rigidly connecting said upper beam rail to said lower beam section;

a support leg arrangement for mounting said lower beam section and its connected beam rail in a horizontal position above a floor;

an elongate, horizontal metal beam member having a top and adapted for carrying electrical and communication wires and cables; and two elongate, end frame sections extending downwardly from opposite ends of said metal beam member to floor level and rigidly connected to said metal beam member, one of said end frame sections being rigidly connected to one end of said beam rail by means of one of said end flanges and to an end of said lower beam section, and said top of metal beam member being at substantially the same height as said top of the upper beam rail, wherein both said upper beam rail and said metal beam member have a plurality of spaced-apart post-receiving holes formed in their respective tops for mounting other components of said office furniture system.

13. A supporting frame assembly according to claim 12 wherein horizontal raceways are mounted on both said spaced-apart frame members and said metal beam member and each raceway is at substantially the same height as the other raceway.

14. A supporting frame assembly according to claim 12 wherein said end frame sections are hollow, have a rectangular, horizontal cross-section, and have access openings formed in vertical sides thereof, and wherein one of said access openings in said one frame section connected to the end of said lower beam section is aligned with and adjacent to an opening formed by said end of the lower beam section.

15. A supporting frame assembly according to claim 12 wherein said lower beam section has a bottom panel with bottom apertures formed therein, at least some of said frame members are upright posts that extend into said lower beam section and have bottom end pieces mounted in said bottom apertures and secured and held by said bottom panel.

16. A supporting frame assembly according to claim 12 wherein said spaced-apart frame members include two upright end posts located at opposite ends of the lower beam section and having bottom ends which are rigidly secured to said top panel of the lower beam section.

17. A supporting frame assembly according to claim 12 wherein said upper beam rail includes two elongate, angle-frame members each having a downwardly extending leg section attached to said vertically extending frame members, and an outwardly extending leg section.

18. A supporting frame assembly for an office furniture system comprising:

a support apparatus including an elongate, hollow lower beam section having top and bottom panels and vertically extending, side panels extending between and rigidly connecting said top and bottom panels, at least some of said panels having access openings formed therein, an elongate, upper beam rail having a top forming a horizontally extending top surface and extending parallel to and spaced-apart from said lower beam section, said beam rail having a plurality of spaced-apart post-receiving holes formed in said top surface and extending through said top of the beam rail for mounting other components of said office furniture system on said upper beam rail, the height of said beam rail being less than the height of said beam section, said beam rail including at least one rail connecting device provided and located at at least one end of said beam rail for rigidly connecting said at least one end of said beam rail to an adjacent end of another beam rail or to other compatible support structure;

vertically extending, spaced-apart elongate posts rigidly connecting said upper beam rail to said lower beam section;

a vertically extending support device for mounting said support apparatus in a horizontal position above a floor; and a support frame arrangement rigidly connected to said support apparatus at one end thereof, said support frame arrangement including an elongate, horizontal metal beam adapted for carrying electrical and communication wires, and two end frame sections extending downwardly from opposite ends of said metal beam and rigidly connected thereto, said end frame sections each having a bottom end adapted for mounting on a floor, wherein said end frame sections are hollow and each has an access opening formed in an outer vertical side thereof, one of said access openings being aligned with and adjacent to another opening formed by an end of said lower beam section.

19. A supporting frame assembly according to claim 18 wherein horizontal raceways are mounted on both said spaced-apart elongate posts and said metal beam member and all of said raceways are mounted at substantially the same height on the supporting frame assembly.

20. A supporting frame assembly according to claim 18 wherein said at least one rail connecting device includes rail connecting end flanges provided at opposite ends of said beam rail, said end flanges having fastener holes formed therein, and one of said end frame sections is connected to one end of said beam rail by means of said end flanges.

21. A supporting frame assembly according to claim 18 including a support wall section comprising at least one panel member and support posts connected to said at least one panel member and extending downwardly therefrom, wherein the or each support wall section is mountable on either said support apparatus by means of said post-receiving holes or on said support frame arrangement by means of further holes formed in said horizontal metal beam.

22. A supporting frame assembly according to claim 18 wherein said lower beam section has end flanges formed on opposite ends thereof with each end flange having at least one fastener-receiving hole, and one of said end frame sections is connected to said support apparatus by means of said end flanges and nut and bolt assemblies.

23. A supporting frame assembly according to claim 18 wherein said top of the upper beam rail is formed by an elongate top plate having a predetermined width, said top is located a predetermined height above said floor, said horizontal metal beam of the support frame forms a frame top defined by an upper frame member, and said frame top has a width and height which match those of said top plate of the beam rail.

24. A supporting frame assembly according to claim 18 wherein said support frame arrangement has an overall width which is the same as the width of the support apparatus.

25. A supporting frame assembly for an office furniture system comprising:

a support frame including an elongate, horizontal beam adapted for carrying electrical and communication wires and cables and having a top forming a horizontally extending top surface, said beam having a plurality of spaced-apart, post-receiving holes formed in said top surface and extending through said top for mounting other components of said office furniture system on said horizontal beam;

two elongate end frame sections extending downwardly from opposite ends of said beam and rigidly connected thereto; and an open-meshed raceway rigidly mounted on a lower portion of said horizontal beam and extending along the length thereof, said raceway extending from said lower portion of said beam and having a horizontal raceway section located directly under at least an upper portion of said beam; and a support apparatus connectible to said support frame at one end thereof and comprising an elongate, hollow lower beam section having top and bottom panels and vertically extending, side panels extending between and rigidly connecting said top and bottom panels, at least some of said panels having access openings formed therein, vertically extending, spaced-apart elongate posts rigidly connected to said lower beam section and extending upwardly therefrom, and an elongate upper beam rail having a top and extending parallel to and spaced-apart from said lower beam section, said beam rail being rigidly connected to said elongate posts and having a plurality of spaced-apart post-receiving holes formed in its top for mounting other components of an office furniture system on said support apparatus.

26. A supporting frame assembly according to claim 25 wherein horizontal raceways are mounted on both said spaced-apart elongate posts and said horizontal beam of the support frame and all of said raceways are at substantially the same height on the supporting frame assembly.

27. A supporting frame assembly according to claim 25 wherein said end frame sections are hollow and each has an access opening formed in an outer vertical side thereof, one of said access openings being aligned with and adjacent to another opening formed by an end of said lower beam section.

28. A supporting frame assembly according to claim 25 including a support wall section comprising at least one panel member and support posts connected to said at least one panel member and extending downwardly therefrom, wherein the support wall section is mountable either in said post-receiving holes of the beam rail or on said support frame by means of further holes formed in said horizontal beam.

29. A supporting frame assembly according to claim 25 wherein said lower beam section has end flanges formed on opposite ends thereof with each end flange having at least one fastener-receiving hole and one of said end frame sections is connected to said support beam by means of said end flanges and nut and bolt assemblies.

30. A supporting frame assembly according to claim 25 wherein said top of the upper beam rail is formed by an elongate top plate having a predetermined width, said top is located a predetermined height above floor level, said horizontal beam of the support frame forms a frame top defined by an upper frame member, and said frame top has a width and height which match those of said top plate of the beam rail.

31. A supporting frame assembly according to claim 25 including electrical outlets mounted on both said horizontal beam of the support frame and on outward faces of said beam rail, wherein said electrical outlets on said horizontal beam are approximately at the same height as the electrical outlets on the beam rail.

32. A supporting frame assembly according to claim 25 wherein said support frame has an overall width which is the same as the width of the support beam.

33. A support apparatus for an office furniture system comprising:

an elongate, hollow lower beam section having top and bottom panels and vertically extending, side panels extending between and rigidly connecting said top and bottom panels, at least some of said panels having access openings formed therein, an elongate, upper beam rail having a top forming a horizontally extending top surface and extending parallel to and spaced-apart from said lower beam section, said beam rail having a plurality of spaced-apart post-receiving holes formed in said top surface and extending through said top of the beam rail for mounting other components of said office furniture system on said upper beam rail, the height of said beam rail being less than the height of said beam section, said beam rail including an elongate channel member having two downwardly and vertically extending edge flanges and forming the top of the upper beam rail, said post-receiving holes being distributed evenly along the length of said channel member, said beam rail further including rail connecting devices provided and located at opposite ends of said beam rail, the rail connecting devices at each end comprising two flanges each having fastener holes formed therein, vertically extending, spaced-apart elongate posts rigidly connecting said upper beam rail to said lower beam section, wherein the rail connecting devices at each end of said beam rail are usable for rigidly connecting their respective end of said beam rail to an adjacent end of another beam rail or to other compatible support structure.

34. A supporting frame assembly for an office furniture system comprising:

a support apparatus including an elongate, hollow lower beam section having top and bottom panels and vertically extending, side panels extending between and rigidly connecting said top and bottom panels, at least some of said panels having access openings formed therein, an elongate, upper beam rail having a top forming a horizontally extending top surface and extending parallel to and spaced-apart from said lower beam section, said beam rail having a plurality of spaced-apart post-receiving holes formed in said top surface and extending through said top of the beam rail for mounting other components of said office furniture system on said upper beam rail, the height of said beam rail being less than the height of said beam section, said beam rail including at least one rail connecting device provided and located at at least one end of said beam for rigidly connecting said at least one end of said beam rail to an adjacent end of another beam rail or to other compatible support structure, vertically extending, spaced-apart elongate posts rigidly connecting said upper beam rail to said lower beam section, and a vertically extending support device for mounting said support apparatus in a horizontal position above a floor; and a support frame arrangement rigidly connected to said support apparatus at one end thereof, said support frame arrangement including an elongate, horizontal metal beam adapted for carrying electrical and communication wires, and two end frame sections extending downwardly from opposite ends of said metal beam and rigidly connected thereto, said end frame sections each having a bottom end adapted for mounting on a floor; and electrical outlets mounted on both said horizontal metal beam of the support frame arrangement and on outward faces of said beam rail, wherein said electrical outlets on said horizontal metal beam are approximately at the same height as the electrical outlets on said beam rail.

* * * * *

UNITED STATES PATENT AND TRADEMARK OFFICE

CERTIFICATE OF CORRECTION

PATENT NO. : 7,143,552 B2
APPLICATION NO. : 10/228225
DATED : December 5, 2006
INVENTOR(S) : Antonius V. Park It is certified that error appears in the above-identified patent and that said Letters Patent is hereby corrected as shown below:

Title page, cited references, replace “DE2207344” with --CA2207344--

Column 2, line 64, delete the second occurrence of “at”

Column 3, line 7, replace “too” with --top--

Column 7, line 25, replace “95” with --96--

Column 14, line 33, delete the second occurrence of “at”

Column 15, line 65, delete the second occurrence of “at”

Column 17, line 19, delete the second occurrence of “at”

Column 20, line 24, delete the second occurrence of “at”

Signed and Sealed this

Tenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,143,552 B2
APPLICATION NO. : 10/228225
DATED : December 5, 2006
INVENTOR(S) : Antonius V. Park It is certified that error appears in the above-identified patent and that said Letters Patent is hereby corrected as shown below:

Column 2, line 64, replace “located at least” with -- located at at least --

Column 14, line 33, replace “located at least” with -- located at at least --

Column 15, line 65, replace “located at least” with -- located at at least --

Column 17, line 19, replace “located at least” with -- located at at least --

Column 20, line 24, replace “located at least” with -- located at at least --

Signed and Sealed this

Twenty-eighth Day of August, 2007

JON W. DUDAS
*Director of the United States Patent and Trademark Office*